United States Patent [19]

Hofmann

[11] 4,133,068

[45] Jan. 9, 1979

[54] CLEANING APPARATUS FOR SUBMERGED SURFACES

[76] Inventor: Helmut J. Hofmann, 1310 Golden Oaks, Corner Claim and Yettah Streets, Hillbrow, Johannesburg, Transvaal Province, South Africa

[21] Appl. No.: 827,185

[22] Filed: Aug. 23, 1977

[30] Foreign Application Priority Data

| | | | |
|---|---|---|---|
| Aug. 23, 1976 | [ZA] | South Africa | 76/5024 |
| Nov. 8, 1976 | [ZA] | South Africa | 76/6672 |
| May 30, 1977 | [ZA] | South Africa | 77/3262 |

[51] Int. Cl.[2] ..... E04H 3/20

[52] U.S. Cl. ..... 15/1.7; 15/404

[58] Field of Search ..... 15/1.7, 404

[56] References Cited

U.S. PATENT DOCUMENTS 4,023,227 5/1977 Chauvier ..... 15/1.7

*Primary Examiner*—Edward L. Roberts

*Attorney, Agent, or Firm*—Sughrue, Rothwell, Mion, Zinn and Macpeak

[57] ABSTRACT

The invention comprises a simple compact automatically operating apparatus for cleaning swimming pools in a stepwise movement over the pool walls comprising a balanced operating head having an inlet and an outlet, the outlet adapted to be swivelably connected to a longitudinally resilient and flexible suction hose. The inlet axis is inclined at an angle of between thirty degrees and sixty degrees to that of the outlet. A pair of passages extend through the head from inlet to outlet, and an oscillatable valve in the head is adapted to alternately close said passages. A baffle plate is placed in the head between the inlet and valve to cause one of the passages to be more restricted and less direct between inlet and outlet than the other and the valve is shaped so that liquid flow through the passages will cause automatic oscillation thereof between terminal positions in each of which one of the passages through the head is closed.

6 Claims, 3 Drawing Figures

CLEANING APPARATUS FOR SUBMERGED SURFACES

Figure 1:
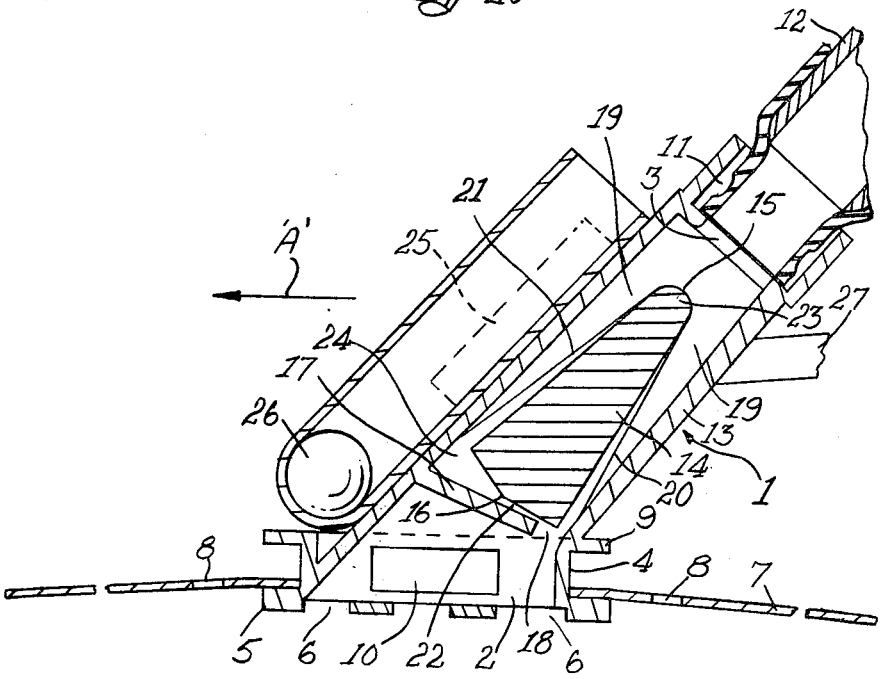

This invention relates to equipment for cleaning submerged surfaces and more particularly to the type of equipment known as "suction sweepers".

Suction sweepers are almost universally used for cleaning submerged surfaces such as swimming pools and the like. Many forms of sweepers have been designed and produced and some of these have included features which make them more or less self-propelled while suction is applied through the equipment. Alternatively this desirable self-propelling action has been obtained by applying an auxiliary fluid flow to the cleaning head.

One effective and simple type of cleaning equipment has been disclosed and relies essentially on cutting off the suction to the operating head of the equipment in a manner which will cause the liquid in the suction pipe to cause the latter to flex and move the head along the surface to be cleaned.

In another form of equipment the suction pipe is connected to the common outlet of a pair of rigid passages which are connected through valve seats to the suction inlet to the equipment. A flapper valve is provided in the operating head which, while suction is applied through the equipment, oscillates automatically to alternately close off the passages to the suction pipe. Because of the particular arrangement of the passages and the valve relative to the inlet opening to the apparatus the action of the valve is such that by striking the valve seats the equipment experiences a driving force that has a net component in a direction parallel to the surface being cleaned. Also as flow is alternately suddenly stopped and accelerated against the inertia of the liquid in the two passages a further impulse force to move the equipment over the surface to be cleaned is generated.

The equipment is provided with balancing and stabilizing features which ensure that is will remain properly orientated when submerged and also preventing it from climbing above the level of the liquid submerging the surface to be cleaned.

The former apparatus tends to move slowly over the surface to be cleaned while the latter with its rigid passages is cumbersome and bulky.

It is the object of the present invention to provide equipment which will effectively clean submerged surfaces and which is neat and compact and which can move over the surface to be cleaned at a rate in the vicinity of twelve feet per minute.

The type of equipment above described has a random movement over the surface to be cleaned and therefor to be effective must move at a useful speed but must also not move fast enough to disturb the dirt on the surfaces to such an extent that it will not be sucked through the equipment to be filtered from the liquid.

According to this invention there is provided apparatus for cleaning submerged surfaces comprising

- a balanced operating head having an inlet and an outlet,
- the outlet adapted to be swivelably connected to a longitudinally resilient and flexible suction hose,
- the inlet axis being inclined at an angle of between thirty degress and sixty degrees to that of the outlet,

- a pair of passages through the head from inlet to outlet,
- an oscillatable valve in the head adapted to alternately close said passages,
- a baffle plate in the head between the inlet and valve to cause one of the passages to be more restricted and less direct between inlet and outlet than the other and
- the valve shaped so that liquid flow through the passages will cause automatic oscillation thereof between terminal positions in each of which one of the passages through the head is closed.

The invention also provides for the valve to operate between parallel surfaces provided in the head, for there to be a pair of valve members which oscillate in opposite directions, and for the balancing to be provided by a bouyancy member and a movable weight.

Still further features of this invention provide for the inlet to the head to be provided through openings allowing flow at right angles to, as well as axially through, the inlet.

Figure 2:
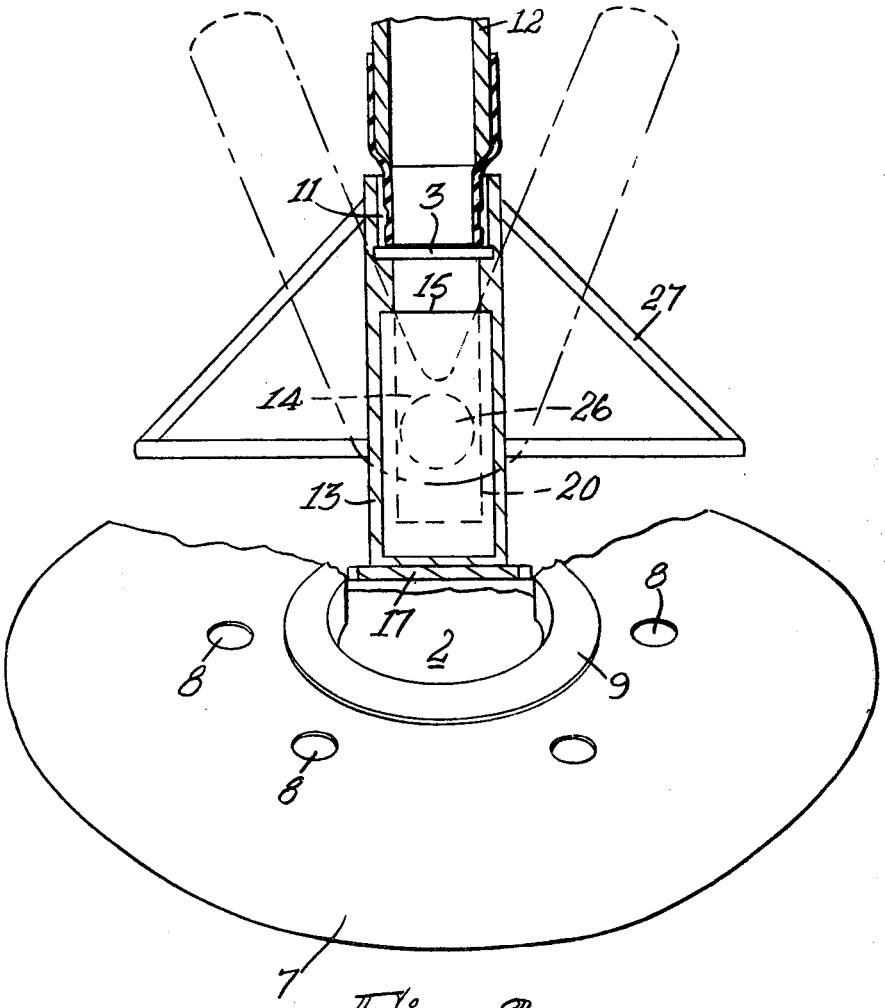
Figure 3:
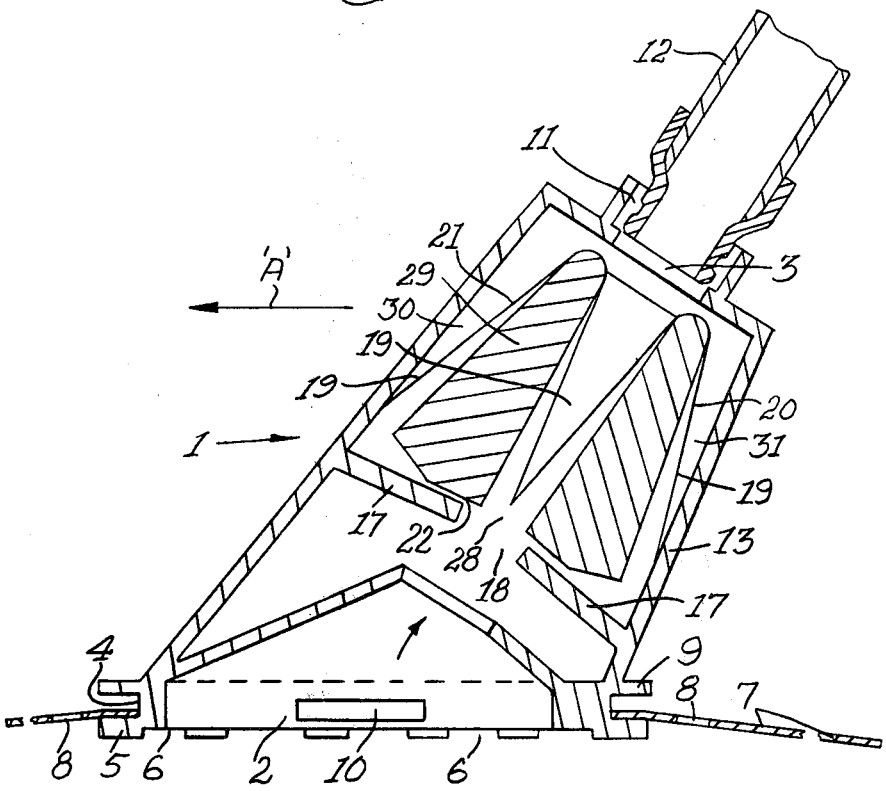

Many other features of this invention will become apparent from the following description of preferred embodiments which are made with reference to the accompanying drawings in which:

FIGS. 1 and 2 show part sectional front and side elevations of one embodiment of the invention, and FIG. 3 is a similar view of FIG. 1 above showing a second embodiment of the invention.

These forms of the invention are designed as swimming pool cleaning apparatus.

Referring to FIGS. 1 and 2 the apparatus consists of an operating head 1 which basically is of rectangular transverse cross-section having circular inlet 2 and outlet 3 openings. The axis of the inlet 2 is offset from that of the outlet 3 at an angle of preferably forty-five degrees. Manufacturing techniques may require that this angle be varied but it is desirable that it be kept as close to forty-five degrees as possible.

The inlet 2 is made as a cylindrical part 4 the lower part 5 of which is adapted to contact the surface to be cleaned. Openings 6 through the wall of part 5 ensure that water may flow into the inlet.

A flexible annular disc 7 is fitted onto the cylindrical part 4 and has apertures 8 therethrough so that water may flow therethrough and through openings 6 when suction is applied to draw water through the head. This limits the force with which the head is held against the surface to be cleaned. A peripheral flange 9 is spaced apart from the lower part 5 and serves to retain the disc 7 in position.

Most of the flow induced by suction takes place through ports 10 in the wall of the cylindrical part as is more fully described below.

The outlet 3 has a swivelable fitting 11 incorporated therein so that the head can be attached to a longitudinally resilient suction pipe 12 which is also flexible.

The body 13 of the head 1 between the inlet 2 and outlet 3 houses an oscillatable valve 14 which may move between terminal positions in each of which one flow passage through the head is open while the other is closed. The valve 14 is of substantially triangular cross-section so that it may oscillate about its apex 15 adjacent the outlet 3. The base of the valve 14 is slightly peaked as indicated at 16 and co-operates with a partition member 17 included in the inlet 2 so that the flow of water through the head 1 is constrained to pass through the opening 18 into and through the body 13. The opening 18 is in a straight line with but offset from the axis of the outlet 3 in the direction opposite of arrow "A".

Internal formations indicated at 19 are provided in the body 13 to constrain the movement of the valve 14 in the body and form valve seals 20 and 21 to close off flow passages through the head 1.

The shape of the base of valve 14 providing peak 16 enables the space 22 between the valve and member 17 to remain substantially constant as the valve moves between its terminal positions and is also balanced. The space 22 may be made about one tenth of the opening 18.

The pivot point 23 of the valve 14 is located on the opposite side of the axis of the outlet 3 to the opening 18 so that it operates partially in a chamber 24 in the body 13 offset from axis of outlet 3.

The valve 14 has a clearance between the sides of the body adjacent which it oscillates.

With the construction above set forth it has been found that when the head is submerged and a swimming pool suction filter applied to the pipe 12 the flow of water causes the valve to oscillate between its two terminal positions. In one such position the flow is substantially direct through opening 18 to outlet 3 while in the other water must pass between member 17 and the base of the valve 14. Water at all times may pass between the sides of the valve 14 and body 13.

It is found that with this construction there is a continuous flow of water through the equipment. However, because the two passages through the head are of different shape and size a pulsation occurs in the flow which causes contractions and relaxations in the longitudinally resilient suction pipe. In consequence of these contractions and relaxations and a simultaneous reduction and increase of the force applied to hold the disc 7 against the surface to be cleaned a step by step movement of the head takes place over the surface to be cleaned.

The movement is automatic but random and to control this a bouyancy chamber 25 is provided. This will preferably be filled with foamed polystyrene. This chamber ensures that while the head will sink onto the surface to be cleaned it will nevertheless be correctly orientated thereto.

Also because the apparatus can operate on vertical walls it is necessary to provide suitable counterbalancing to prevent the head from climbing above the water level and allowing air to be drawn through the system. This can be easily effected in known manner by having a freely movable weight 26 in a Vee-shaped guide attached to the body 13 across the width thereof. It may be fitted to either the upper or lower surface of the body.

To prevent the apparatus from driving itself into positions where it can not move a flexible pouted guide 27 in the form of an open triangle of resilient plastics material is fitted to project from the head in the opposite direction to arrow "A" which is direction of normal movement of the apparatus.

In use all that is necessary is for the swimming pool suction filter equipment to be connected to the head through longitudinally resilient and flexible piping and the head placed on the floor. It will then move randomly over the floor and, if the sides and bottom of the pool do not meet too sharply, also the sides of the pool. As the disc 7 moves over the floor it loosens any dirt thereon which is sucked through ports 10 and through the head into the filter. It can be allowed to operate whenever the filter is operated and requires no attention.

Where a greater volume of water is required to be filtered the alternative construction shown in FIG. 3 can be used. This construction is basically a pair of assemblies as above described located in a back to back relationship. The wall of the body 13 which provides the valve seat to close off the direct passage through the head is removed from both assemblies and the valves act in synchronism but in opposite directions.

This assembly results in a direct passage 28 through the head which the valves 29 close off when they contact each other and a pair of passages in opposite sides 30 and 31 of the body. The latter are closed by valves 29 in their terminal positions remote from each other. Apart from the above the overall construction will be similar to that described with reference to FIGS. 1 and 2.

It will be appreciated that the embodiments have been described with the valve or valves oscillating in a plane which is vertical to the surfact to be cleaned. It is, of course, possible to have the valve work in a plane at right angles to this vertical plane and also to make other modifications to the constructions without departing from the scope of this invention.

The apparatus will preferably be moulded in plastics material and polypropylene has been found suitable for use in the manufacture of the valves.

What I claim as new and desire to secure by Letters Patent is:

1. Apparatus for cleaning submerged surfaces comprising:
   - a balanced operating head having an inlet and an outlet defining respective inlet and outlet axes,
   - the outlet adapted to be swivelably connected to a longitudinally resilient and flexible suction hose,
   - the inlet axis being inclined at an angle of between thirty degrees and sixty degrees to that of the outlet axis,
   - a pair of passages through the head from inlet to outlet,
   - an oscillatable valve in the head adapted to alternately close said passages,
   - a baffle plate in the head between the inlet and valve to cause one of the passages to be more restricted and less direct between inlet and outlet then the other and
   - the valve shaped so that liquid flow through the passages will cause automatic oscillation thereof between terminal positions in each of which one of the passages through the head is closed.

2. Apparatus as claimed in claim 1 in which parallel surfaces are formed in the head to guide the movement of the valve.

3. Apparatus as claimed in claim 1 in which the inlet to the head is formed as a cylindrical part having openings into one end and through the side wall of this part.

4. Apparatus as claimed in claim 3 in which an annular flexible disc with apertures therethrough is located on the cylindrical part.

5. Apparatus as claimed in claim 4 having a bouyancy chamber and movable balance weight associated therewith.

6. Apparatus for cleaning submerged surfaces comprising:
   - a balanced operating head having an inlet and an outlet defining respective inlet and outlet axes, the oulet adapted to be swivelably connected to a longitudinally resilient and flexible suction hose, the inlet axis being inclined at an angle of between thirty degrees and sixty degrees to that of the outlet axis, value means comprising a pair of valves provided in the head, said valves adapted to close a first passage means between them or a second passage means defined by separate passages in the body on the opposite sides of the valves, a baffle plate in the head between the inlet and valve to cause one of the passages to be more restricted and less direct between inlet and outlet than the other and the valve means shaped so that liquid flow through the passages will cause automatic oscillation thereof between terminal positions in each of which one of the first and second passage means through the head is closed.

* * * * *